US008499748B2

(12) United States Patent
Braic et al.

(10) Patent No.: US 8,499,748 B2
(45) Date of Patent: Aug. 6, 2013

(54) DEVICE FOR EXHAUST GAS RECIRCULATION FOR AN INTERNAL COMBUSTION ENGINE

(75) Inventors: Viorel Braic, Stuttgart (DE); Georg Feldhaus, Stuttgart (DE); Tobias Fetzer, Ostfildern (DE); Chi-Duc Nguyen, Stuttgart (DE); Mark Schienemann, Remseck (DE)

(73) Assignee: Behr GmbH & Co. KG, Stuttgart (DE)

( * ) Notice: Subject to any disclaimer, the term of this patent is extended or adjusted under 35 U.S.C. 154(b) by 0 days.

(21) Appl. No.: 13/593,125

(22) Filed: Aug. 23, 2012

(65) Prior Publication Data

US 2013/0042840 A1 Feb. 21, 2013

Related U.S. Application Data

(63) Continuation of application No. PCT/EP2011/051894, filed on Feb. 9, 2011.

(30) Foreign Application Priority Data

Feb. 23, 2010 (DE) ..... 10 2010 002 233

(51) Int. Cl.
*F02B 47/08* (2006.01)
*F02B 47/10* (2006.01)

(52) U.S. Cl.
USPC ..... 123/568.17; 701/108

(58) Field of Classification Search
USPC ..... 123/568.11, 568.12, 568.15, 568.17, 123/568.18, 698, 559.1, 316, 184.42; 60/605.1, 60/605.2, 278, 280; 701/108
See application file for complete search history.

(56) References Cited

U.S. PATENT DOCUMENTS

| | | | | |
|---|---|---|---|---|
| 5,207,714 | A | 5/1993 | Hayashi et al. | |
| 6,422,221 | B2 | 7/2002 | Pietrowski et al. | |
| 6,895,948 | B2 | 5/2005 | Mori et al. | |
| 7,073,491 | B2 * | 7/2006 | Yi | 123/568.12 |
| 2002/0000222 | A1 * | 1/2002 | Matsuura et al. | 123/568.11 |
| 2002/0124553 | A1 * | 9/2002 | Lucas et al. | 60/278 |
| 2004/0079348 | A1 * | 4/2004 | Mori et al. | 123/568.17 |
| 2005/0235972 | A1 * | 10/2005 | Yi | 123/568.12 |
| 2009/0223476 | A1 | 9/2009 | Shinkai et al. | |
| 2010/0154759 | A1 * | 6/2010 | Taira | 123/568.17 |

FOREIGN PATENT DOCUMENTS

| | | | |
|---|---|---|---|
| DE | 196 31 337 | A1 | 2/1998 |
| DE | 103 48 575 | A1 | 5/2004 |
| EP | 1 122 421 | A2 | 8/2001 |
| EP | 1 508 685 | A1 | 2/2005 |
| EP | 2 098 716 | A2 | 9/2009 |
| WO | WO 97/34081 | | 9/1997 |

* cited by examiner

*Primary Examiner* — Mahmoud Gimie
(74) *Attorney, Agent, or Firm* — Muncy, Geissler, Olds & Lowe, PLLC

(57) ABSTRACT

A device for exhaust-gas recirculation for an internal combustion engine is provided that includes a flange for attaching to a cylinder head of the internal combustion engine. Combustion air flows from a passage region of the flange directly into at least one intake duct of a cylinder, and an inlet for an inflow of recirculated exhaust gas into the combustion air is provided. The inlet for the inflow of the recirculated exhaust gas is arranged on the flange.

23 Claims, 3 Drawing Sheets

DEVICE FOR EXHAUST GAS RECIRCULATION FOR AN INTERNAL COMBUSTION ENGINE

This nonprovisional application is a continuation of International Application No. PCT/EP2011/051894, which was filed on Feb. 9, 2011, and which claims priority to German Patent Application No. DE 10 2010 002 233.0, which was filed in Germany on Feb. 23, 2010, and which are both herein incorporated by reference.

BACKGROUND OF THE INVENTION

1. Field of the Invention

The present invention relates to a device for exhaust gas recirculation [EGR] for an internal combustion engine.

2. Description of the Background Art

The exhaust gas for internal combustion engines is recirculated for various reasons. For example, environmentally harmful nitrous oxides arise in the engine at high combustion temperatures, above all in the case of diesel engines. To reduce the oxides, the combustion temperature must be lowered. For this reason, part of the exhaust gas is added to the combustion air in the partial load region over a return line, whereby the recirculated exhaust gas quantity is regulated by a regulating element. In the majority of cases, the recirculated exhaust gas is added to the combustion air upstream of an intake manifold.

SUMMARY OF THE INVENTION

It is therefore an object of the invention provide an EGR device, which has an especially compact structure.

In an embodiment, an arrangement of the inlet for the recirculated exhaust gas on the flange, which can be provided directly on the cylinder head of the internal combustion engine, opens, inter alia, the possibility of short pathways for the recirculating exhaust gas line. The position of the inlet, moreover, has the advantage that the flange, because of the cylinder head temperature, includes a temperature-resistant material, so that the exhaust gas inlet can be integrated without any problems.

In an exemplary embodiment, the flange in this case can be made of a metal, for example, a light metal, for instance, an aluminum alloy.

In an embodiment of the invention, the flange is formed as part of an intake manifold module, whereby in another preferred but not necessary detail embodiment a charge air cooler is integrated into the intake manifold module. The intake manifold module advantageously comprises but not necessarily the flange and a module body that can be fastened to the flange. Thus, for example, an indirect charge air cooler can be integrated into the module body. In alternative embodiments, a direct charge air cooler and/or an indirect charge air cooler can also be provided at another place, whereby the intake manifold module is formed only as a hollow space. The flange within the meaning of a device of the invention can be designed as a classic intake manifold with division of the passage region into a number of separate inlet ducts. Preferably, in a preferred detail embodiment it is designed as a flange with a passage region which is continuously open and extends over a number of cylinders in the transverse direction.

In an embodiment, the exhaust gas before flowing into the combustion air does not pass through any exhaust gas cooler, whereby the combustion air is preferably, but not necessarily, compressed. This arrangement therefore deals with an uncooled high-pressure EGR, which can be realized especially cost-effectively and compactly. In very general terms, the present invention in this case relates to exhaust gas recirculations that have high recirculation rates in normal operating states, particularly recirculation rates of more than 20%. Such high recirculation rates are used preferably to meet current requirements for pollutant emission in internal combustion engines, particularly diesel engines. In alternative embodiments of the invention, however, an exhaust gas cooler for the recirculated exhaust gas can also be provided.

Furthermore, an exhaust gas-conducting duct advantageously extends over a transverse direction of the passage region, whereby in a preferred detail embodiment the duct comprises a plurality of outlet openings. Advantageously, in this regard, the plurality of outlet openings is defined in position and/or size according to their through opening, especially preferably in a different manner. As a result, a predefined distribution of the exhaust gas to different sectors of the passage region can be realized. Particularly in this case a distribution can occur to a plurality of combustion engine cylinders lying in series one behind the other in regard to the exhaust gas stream, whereby, for instance, the through openings in the flow direction along the duct are larger to supply the cylinders uniformly with the recirculated exhaust gas.

In an embodiment of the invention, on an inside edge of the flange an exhaust gas-conducting duct channel is formed, which extends over at least one part of the inside edge, whereby the exhaust gas flows into the combustion air through one or more openings of the duct channel. Such a duct channel can be realized simply in structural terms, for example, by a materially uniform integrated design at a flange produced as a cast part. Alternatively or in addition, the duct channel can be formed totally or partially as a sheet metal part placed on the inside edge of the flange or another molded part.

Further, at least one opening of the duct channel can have an orifice member, whereby the orifice member in preferred detail embodiment is formed as a shielding cap and/or as a nozzle member projecting into the passage region. The design as a shielding cap can be used in particular to prevent the freezing of condensate in the openings of the duct channel, which is definitely possible during cold seasons and in warm-up phases. Specially formed nozzle members can project into the passage region to achieve a more precisely positioned and/or better swirled inflow of the exhaust gas. Such nozzle members can also project from the flange into the particular intake ports of the cylinder head to enable further optimization of the inflow according to the requirements.

In an embodiment of the invention, an exhaust gas-conducting tubular member, which projects into the passage region and has at least one outlet opening, is disposed on the flange. In a preferred refinement, the tubular member has a plurality of outlet openings distributed over its length. Such a tubular member can be produced simply and cost-effectively as a single part, whereby a modular design principle is encouraged for a device of the invention in regard to the material selection, length, and other parameters.

In an embodiment, the tubular member has a cross-sectional shape optimized in terms of flow mechanics, especially preferably a circular shape, an oval shape oriented along the combustion air, or a wing shape. As a result, the flow resistance of the tubular member in the passage through which the combustion air flows can be reduced or also increased, if so desired, to generate turbulences for better mixing of the recirculated exhaust gas.

In another embodiment, a sliding member is disposed in the tubular member, whereby a metering of the recirculated exhaust gas quantity can be adjusted by movement of the sliding member relative to the tubular member. Especially preferably, this can be a rotational movement or also a linear movement. As a result, a regulating element for adjusting the recirculated exhaust gas quantity can be provided especially simply and cost-effectively in a device according to the invention.

In an embodiment, an inlet opening for the exhaust gas can be disposed on the flange, whereby a regulating member for controlling a recirculated exhaust gas quantity is disposed directly at the inlet opening. In this way, an integrated construction is favored, as a result of which space and cost are saved. In an advantageous refinement, the inlet opening is disposed in this case laterally next to the passage region, whereby the exhaust gas for optimized utilization of the available space is supplied from the one side relative to a flange plane and the regulating member is disposed on the other side relative to the flange plane. The regulating member can be an adjustable valve member in a construction method known per se.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
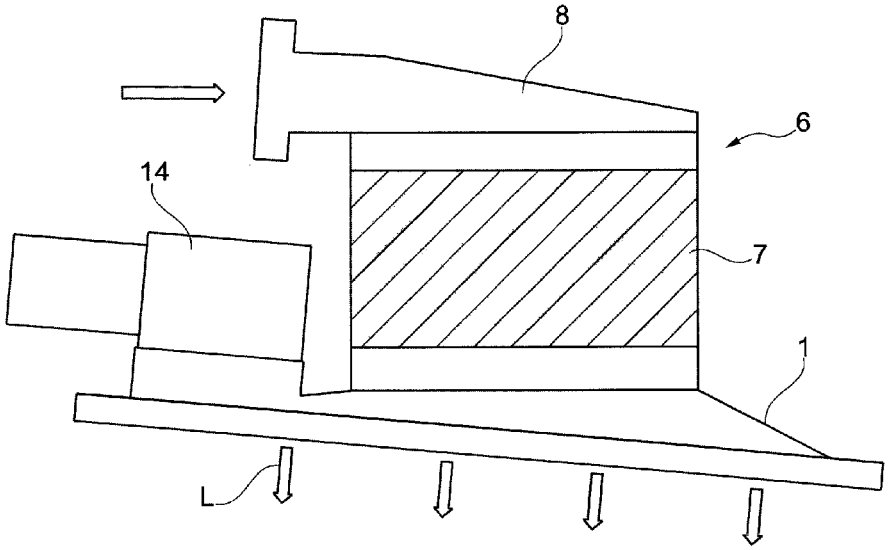
FIG. 1 shows an overall schematic view of a device according to an embodiment of the invention.

The schematic view, shown in FIG. 1, of a device of the invention comprises a flange 1, which is formed as a pressure cast aluminum part and with a flange plane 2 is directly adjacent to a cylinder head of an internal combustion engine (not shown). The more precise detail embodiment of the device, shown schematically in FIG. 1, according to FIG. 2 makes clear that flange 1 can be screwed together with the cylinder head in a known manner by means of a number of bored holes 3, whereby a seal 4 is disposed in flange plane 2.

Flange 1 has a passage region 5, which in the present case in cross-sectional shape is, for instance, a rectangle extending in the transverse direction and is used for the flow-through of compressed combustion air for supplying the individual cylinders of the internal combustion engine.

The internal combustion engine in the exemplary embodiments shown in the present case is in each case a four-cylinder diesel engine.

In regard to the flow direction of the combustion air L upstream, a module body 6 in which an indirect or liquid-cooled charge air cooler 7 is disposed is attached to flange 1. Charge air cooler 7 in the present case is constructed as a tube bundle heat exchanger with a stack of flat tubes 7*a*. Module body 6 with charge air cooler 7 provided therein, together with flange 1 and a supply member 8 for the combustion air, form an intake manifold module. The intake manifold module 1, 6, 7, 8 has a compact, integrated structure and comprises several functions such as, for instance, the flowing in of the recirculated exhaust gas with its regulation and the cooling of the compressed combustion air.

Figure 2:
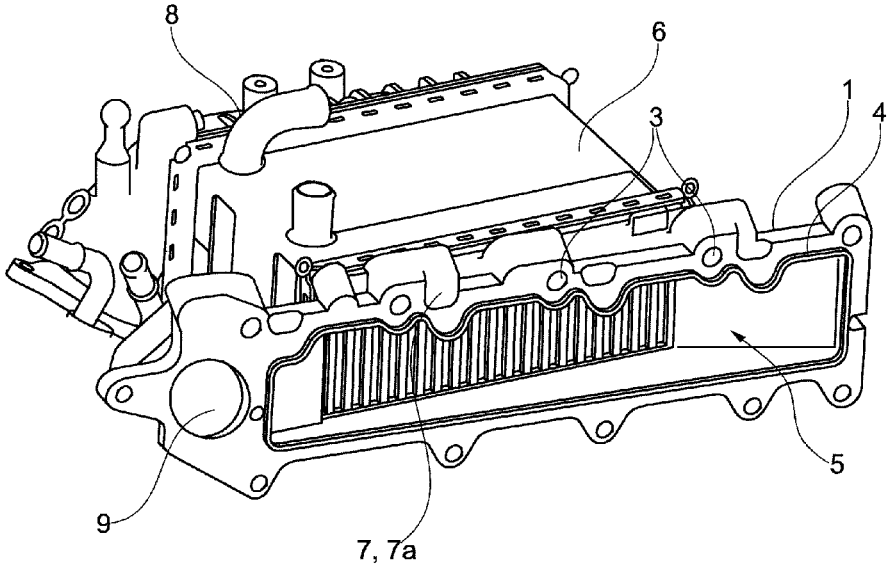
FIG. 2 shows a spatial view of a first exemplary embodiment of a device of the invention.
Figure 3:
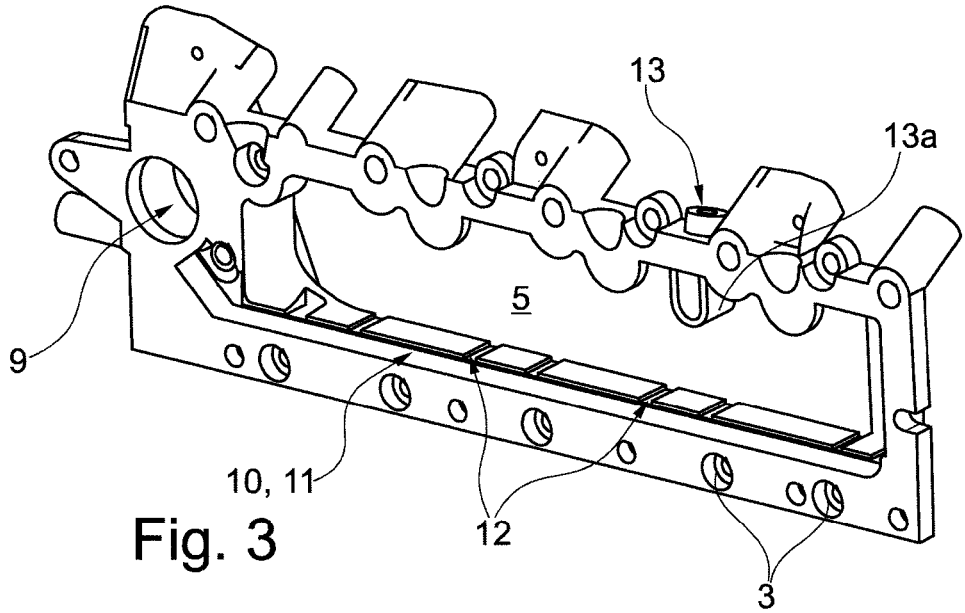
FIG. 3 shows a spatial view of a flange of the example of FIG. 2.

Flange 1 of FIG. 2 is shown in greater detail in FIG. 3 in a structurally slightly modified form. Provided at flange 1 laterally next to passage region 5, more precisely next to a short front end of the rectangular passage cross section, is an inlet opening 9 for the exhaust gas, which leads to an exhaust gas-conducting duct 10, which extends in the form of an edge duct channel 11 along a longitudinal side of passage region 5 along its inside edge. Duct channel 10 is formed as a groove-like indentation in the surface of flange plane 2, which is possible in an especially simple manner in the formation as a pressure cast part. Thus, the surface of the connecting flange of the cylinder head forms a cover of duct channel 11. In alternative embodiments, however, an additional cover can also be provided, or duct channel 11 can be formed in another manner such as, for instance, a mounted sheet metal part.

Duct channel 11 has over its length a number of outlet openings 12, which in the present case are shaped as rectangular recesses in the side wall of the groove-like duct channel 11 in the direction of passage region 5. Outlet openings 12 are aligned in their position to the arrangement of the cylinders or their intake ports. The size of outlet openings 12 over the course of duct channel 11 can be variable to assure exhaust gas inflow as uniform as possible for each of the cylinders of the internal combustion engine.

Opposite to duct channel 11 on the other longitudinal side of passage region 5 an aperture 13 is provided, in which a measuring sensor, for example, a pressure and/or temperature sensor, can be placed. In order to avoid direct exposure to the hot and corrosive exhaust gas, a protective cover 13*a* is formed over opening 13 for the sensor on the inside of passage region 5.

Inlet opening 9 for the exhaust gas is formed on flange 1, so that an exhaust gas line can be screwed from the side of the cylinder head to flange 1, whereby inlet opening 9 lies in flange plane 2. A regulating member 14 in the form of a control valve can be attached to the opposite side of inlet opening 9, so that the quantity of the recirculated exhaust gas stream can be adjusted and regulated.

The present case deals with a high-pressure EGR of uncooled exhaust gas, so that the recirculated exhaust gas stream can reach typical temperatures above 400° C. and even up to 500° C. However, the shown embodiments of the device of the invention are not in any way opposed to recirculation of cooled exhaust gas.

Figure 4:
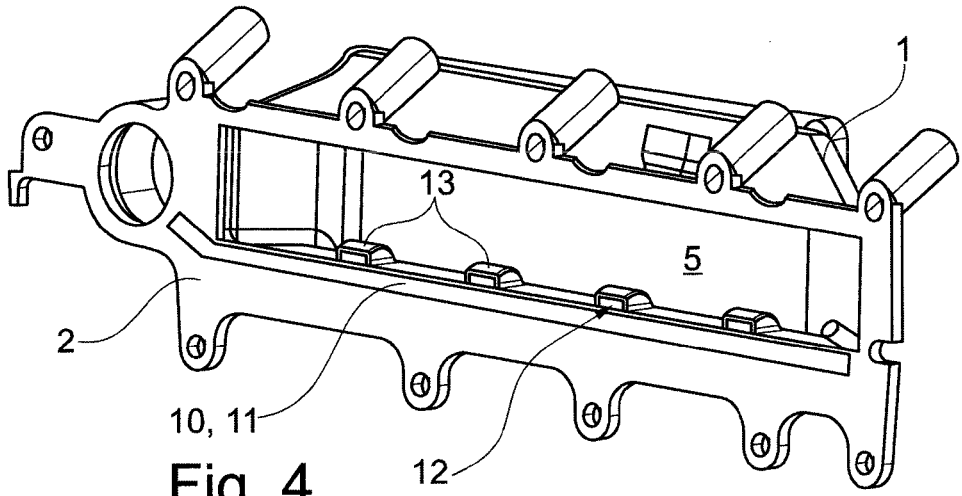
FIG. 4 shows a spatial view of a first variation of the flange of FIG. 3.

In the variation of flange 1 of FIG. 3 as shown in FIG. 4, outlet openings 12 are each formed as a shielding cap 13. This shape has the purpose that, for example, in warm-up phases during cold seasons no condensate accumulating in duct channel 11 can freeze in openings 12 and block these. Shielding caps 13 are opened in the flow direction of the combustion air, so that the quantity of the outflowing exhaust gas is not limited by the combustion air flowing countercurrently.

Depending on the pressure conditions of the recirculated exhaust gas, combustion air, and/or other requirements, it can also be provided that shielding caps 13 are oriented opposite to the flow direction of the combustion air, in order to improve, for example, a swirling of the inflowing exhaust gas.

Instead of shaping outlet openings 12 as shielding caps 13, in an alternative detail embodiment, which is not shown, these can also be formed as nozzle members, which can extend particularly over a path into passage region 5, or also project proceeding from duct channel 11 directly into the intake ports of the cylinder head.

Figure 5:
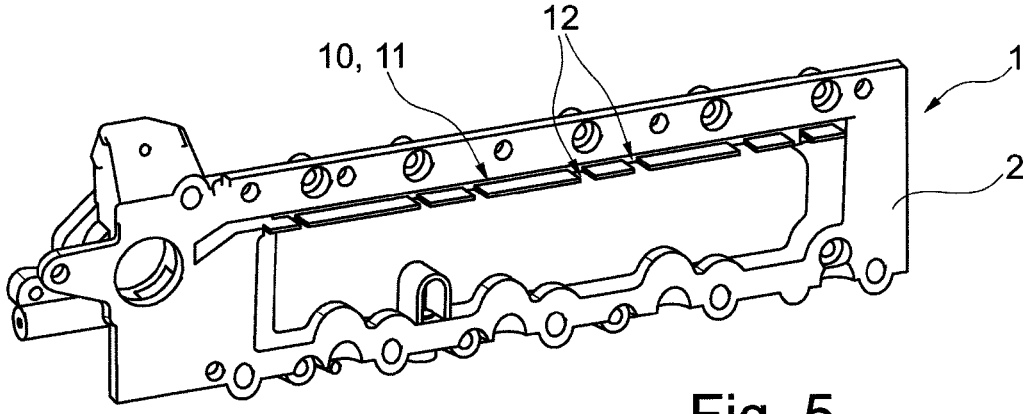
FIG. 5 shows a spatial view of a second variation of the flange of FIG. 3.

In the variation shown in FIG. 5, in contrast to the exemplary embodiment according to FIG. 3, duct channel 11 is disposed at the upper longitudinal side of passage region 5 and not at the lower longitudinal side. This can offer advantages in regard to a condensate problem depending on requirements.

Figure 6:
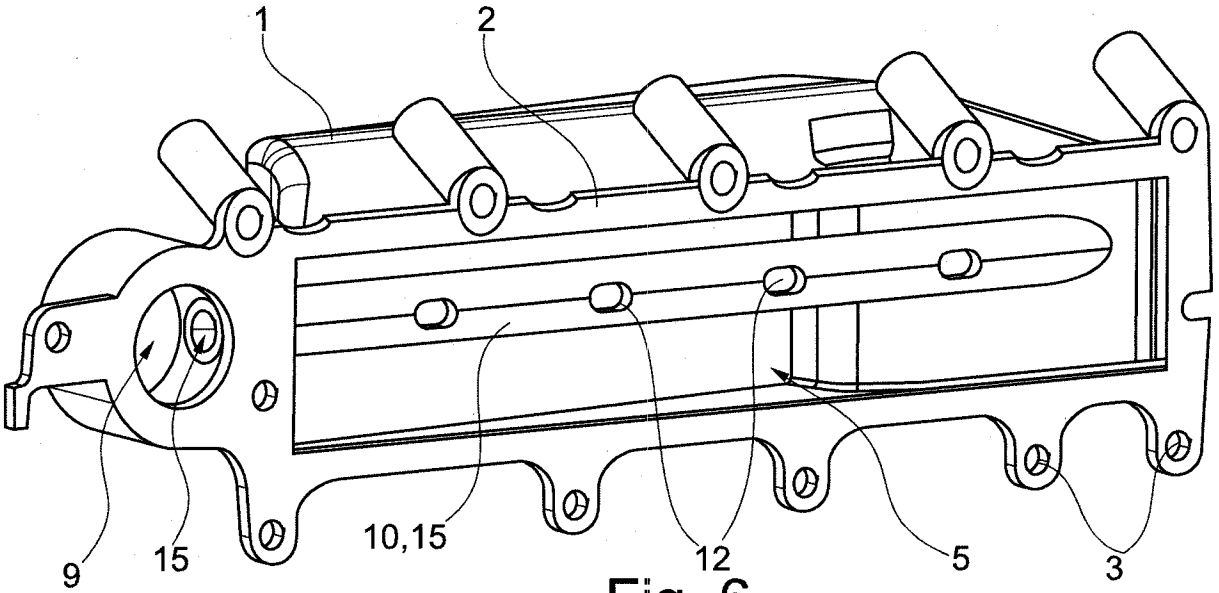
FIG. 6 shows the flange of a second preferred exemplary embodiment of a device of the invention.

FIG. 6 shows a second exemplary embodiment of the invention, in which the exhaust gas-conducting duct 10 is shaped as a tubular member 15. Tubular member 15 extends along the longitudinal direction of passage region 5 and at about half the height relative to the short transverse direction (vertical direction). Tubular member 15 is therefore oriented substantially perpendicular to the flow direction of the combustion direction. It has a number of outlet openings 12, which are correlated in their position to the individual cylinders and are formed like outlet openings 12 of duct channel 11 in the exemplary embodiment described above defined in their size or distribution density.

Figure 7:
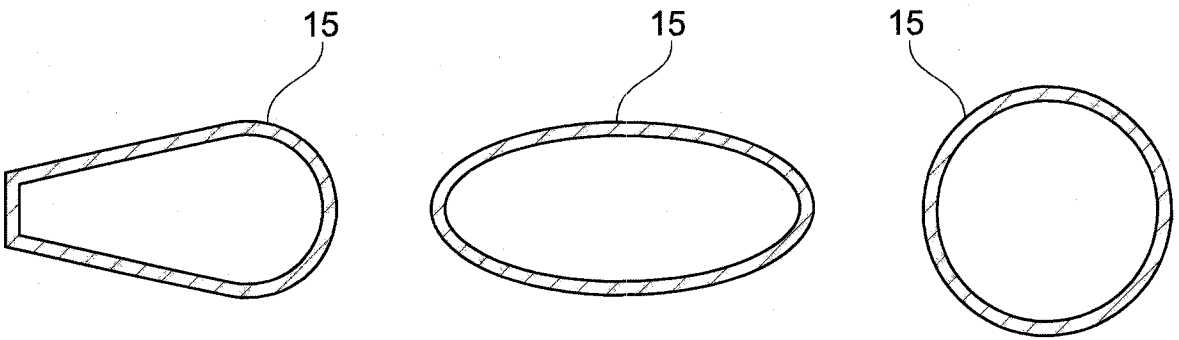
FIG. 7 shows different preferred cross sections through a tubular member of the flange of FIG. 6.

To offer the lowest possible flow resistance for the combustion air or, according to requirements, also to generate an especially great swirling for a better distribution of the inflowing exhaust gas, tubular member 14 can have defined tube cross sections, as they are shown in FIG. 7 by way of example. Preferably, this can be a wing cross section (left drawing), an oval cross section (middle drawing), or also a circular cross section (right drawing).

In a refinement (not shown) of the exemplary embodiment according to FIG. 6, a sliding member can be disposed in tubular member 14 in the form of another tubular member provided with openings. The recirculated exhaust gas quantity can be regulated by rotation or longitudinal displacement of the sliding member, by changes of the coverings of the openings. By means of the sliding member in conjunction with tubular member 15 and a suitable actuator for moving the sliding member, thus overall a regulating member 14 is provided for regulating the recirculated exhaust gas quantity.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for exhaust gas recirculation for an internal combustion engine, the device comprising:

a flange adapted to attach to a cylinder head of the internal combustion engine, whereby combustion air flows from a passage region of the flange directly into at least one intake port of a cylinder; and an inlet opening that receives recirculated exhaust gas and directs the recirculated exhaust gas into the combustion air, the inlet being disposed on the flange, wherein the passage region has an elongated shape that extends along a length direction of the flange.

2. The device according to claim 1, wherein the flange is configured as part of an intake manifold module, and wherein a charge air cooler is integrated into the intake manifold module.

3. The device according to claim 2, wherein the intake manifold module comprises the flange and a module body that is configured to be fastened to the flange.

4. The device according to claim 1, wherein the exhaust gas, before flowing into the combustion air, does not pass through any exhaust gas cooler, and wherein the combustion air is compressed.

5. The device according to claim 1, wherein an exhaust gas-conducting duct extends over a transverse direction of the passage region, and wherein the exhaust gas-conducting duct comprises a plurality of outlet openings.

6. The device according to claim 5, wherein the plurality of outlet openings is formed defined in position and/or through opening in a different manner.

7. The device according to claim 1, wherein, on an inside edge of the flange, an exhaust gas-conducting duct channel is formed that extends over at least one part of the inside edge, and wherein the exhaust gas flows into the combustion air through one or more openings of the duct channel.

8. The device according to claim 7, wherein the flange is formed at least partially material uniformly, as a single piece and/or as a cast part, with the duct channel.

9. The device according to claim 7, wherein at least one of the openings of the duct channel has an orifice member, and wherein the orifice member is formed as a shielding cap and/or as a nozzle member projecting into the passage region.

10. The device according to claim 1, wherein an exhaust gas-conducting tubular member projects into the passage region and has at least one outlet opening, and wherein the exhaust gas-conducting tubular member is disposed on the flange.

11. The device according to claim 10, wherein the tubular member has a plurality of outlet openings distributed over its length.

12. The device according to claim 10, wherein the tubular member has a cross-sectional shape optimized with respect to flow mechanics, including one of a circular shape, an oval shape oriented along the combustion air, or a wing shape.

13. The device according to claim 10, wherein a sliding member is disposed in the tubular member, wherein a metering of the recirculated exhaust gas quantity is adjustable by movement of the sliding member relative to the tubular member, the movement being a rotational movement or linear movement.

14. The device according to claim 1, wherein the inlet opening for the exhaust gas is disposed on the flange, and wherein a regulating element for controlling a recirculated exhaust gas quantity is disposed directly at the inlet opening.

15. The device according to claim 14, wherein the inlet opening is disposed laterally next to the passage region, wherein the exhaust gas is supplied from a first side relative to a flange plane and the regulating member is disposed on a second side relative to the flange plane.

16. The device according to claim 1, wherein a single passage region is provided in the flange.

17. The device according to claim 16, wherein an exhaust gas-conducting duct is provided and extends along the length of one side of the single passage region, the exhaust gas-conducting duct including a plurality of outlet openings that open into the single passage region.

18. The device according to claim 17, wherein the outlet openings vary in size from one another.

19. The device according to claim 10, wherein the exhaust gas-conducting tubular member projects into the passage region and extends substantially a length of the passage region.

20. The device according to claim 1, wherein the flange is formed of an aluminum alloy.

21. The device according to claim 17, wherein the exhaust gas-conducting duct is substantially straight along its length.

22. The device according to claim 1, wherein the passage region is elongated to extend substantially a length of the flange.

23. The device according to claim 1, wherein the length direction of the flange extends substantially perpendicular to a flow direction of the combustion air.

* * * * *